US007184514B2

(12) United States Patent
Kudo

(10) Patent No.: US 7,184,514 B2
(45) Date of Patent: Feb. 27, 2007

(54) X-RAY CT APPARATUS

(75) Inventor: Hidetoshi Kudo, Nasushiobara (JP)

(73) Assignees: Kabushiki Kaisha Toshiba, Tokyo (JP); Toshiba Medical Systems Corporation, Otawara (JP)

( * ) Notice: Subject to any disclaimer, the term of this patent is extended or adjusted under 35 U.S.C. 154(b) by 0 days.

(21) Appl. No.: 11/007,242

(22) Filed: Dec. 9, 2004

(65) Prior Publication Data

US 2005/0163285 A1 Jul. 28, 2005

(30) Foreign Application Priority Data

Dec. 10, 2003 (JP) ..... 2003-411582

(51) Int. Cl.
*H05G 1/60* (2006.01)
*H01J 35/10* (2006.01)

(52) U.S. Cl. ..... 378/16; 378/19; 378/144

(58) Field of Classification Search ..... 378/124, 378/143, 144, 119, 136, 125, 98.8, 4, 16, 378/19

See application file for complete search history.

(56) References Cited

U.S. PATENT DOCUMENTS

| | | | | |
|---|---|---|---|---|
| 2,587,498 | A * | 2/1952 | Marsh | 209/408 |
| 3,250,916 | A * | 5/1966 | Rogers | 378/41 |
| 3,851,204 | A * | 11/1974 | Rollfinke | 378/144 |
| 4,712,226 | A * | 12/1987 | Horbaschek | 378/134 |
| 5,907,592 | A * | 5/1999 | Levinson | 378/4 |
| 6,275,560 | B1 * | 8/2001 | Blake et al. | 378/8 |

FOREIGN PATENT DOCUMENTS

| | | |
|---|---|---|
| JP | 10-275693 | 10/1998 |
| JP | 11-135044 | 5/1999 |

* cited by examiner

*Primary Examiner*—Edward J. Glick
*Assistant Examiner*—Irakli Kiknadze
(74) *Attorney, Agent, or Firm*—Oblon, Spivak, McClelland, Maier & Neustadt, P.C.

(57) ABSTRACT

An X-ray tube comprises a cathode configured to emit a heat electron, a target, including a plurality of areas where target angles are different in a rotation direction, which the heat electron collides with, and a rotation mechanism configured to rotate the target in the rotation direction.

5 Claims, 11 Drawing Sheets

X-RAY CT APPARATUS

CROSS-REFERENCE TO RELATED APPLICATIONS

This application is based upon and claims the benefit of priority from prior Japanese Patent Application No. P2003-411582 filed on Dec. 10, 2003, the entire contents of which are incorporated herein by reference.

FIELD OF THE INVENTION

The present invention relates generally to an X-ray CT apparatus which irradiates X-ray from a rotating anode X-ray tube to an object and detects the X-ray passing through the object by an X-ray detector including a plurality of detection element segments.

BACKGROUND

Generally, a rotating anode X-ray tube is used as a source of X-ray irradiation source of X-ray CT apparatus. This rotating anode X-ray tube mainly includes a cathode part and an anode part. The cathode part includes a filament which emits a heat electron, and a focusing electrode having focusing slot, positioned around the filament, which focuses the heat electron emitted from the filament on a target of the anode. The anode part is positioned opposite to the cathode part and including the target which is an umbrella-shaped, a rotation mechanism part which supports and rotates the target, and the fixed part which rotatably supports the rotation mechanism part.

In the rotating anode X-ray tube, a high voltage is impressed between the cathode part and the anode part to irradiate the X-ray from a focus of the target. Since a lot of heat is generated from the anode part in this case, an X-ray tube container (hereinafter referred as a tube container) is used as an inclusion body. In the tube container, the rotating anode X-ray tube is supported in an insulated oil to be insulated. The tube container includes an X-ray radiation window near the target of the rotating anode X-ray tube, and a cable receptacle to introduce the high voltage near the cathode part and the anode part.

A cathode side high-voltage cable is connected to the cable receptacle by-the side of the cathode, and negative high voltage and filament heating voltage for heating the filament are introduced. Moreover, an anode side high-voltage cable is connected to the cable receptacle by the side of the anode, and positive high voltage is introduced into it. However, an anode grounding type cable receptacle may be used instead. Moreover, a stator for rotating the anode part is attached near the rotation mechanism part of the anode part.

As mentioned above, the high voltage, such as 100 and dozens of kV, is impressed between the cathode part and the anode part, and the rotating anode X-ray tube generates the X-ray, when the heat electron emitted from the filament of the cathode part collides with the target of the anode part. The filament has a coil where a thin wire of an electronic radiation material, such as tungsten is winded, and a filament heating current is sent to the filament to be heated to a high temperature. From the heated filament, the heat electron of quantity corresponding to the temperature is emitted, and electric field formed by the high voltage impressed between the cathode part and the anode part accelerates the heat electron towards an anode part as an electron beam. At this time, the electron beam is focused on the target of the anode part as a desired size focus by the electric field formed by the focusing slot of the focusing electrode.

A flow of the electron beam is an X-ray tube current, and the high voltage impressed between the cathode part and the anode part is an X-ray tube voltage. Dose of the X-ray generated from the target becomes large when values of the X-ray tube current and the X-ray tube voltage are large. Moreover, the dose of the X-ray depends on the material of the target, and becomes large when the atomic number of the target material is large. However, since a generating efficiency of the X-ray in a range of the X-ray tube voltage used for X-ray imaging is so low, such as 1% or less, much energy caused by the electron beam which collides with the focus of the target is transformed into thermal energy. For this reason, the target of the anode part rotates at high speed by the rotation mechanism part, in order to avoid local overheating of the focus by the electronic beam.

As mentioned above, the target has a umbrella shaped face, and the X-ray generated from the target is emitted in a direction corresponding to an angle of inclination of the face (hereinafter referred as an target angle) which is an angle between the target face and a face perpendicular to an rotation axis of the target. The X-ray which passes through the X-ray radiation window is irradiated to a patient. The shape of the target is described in Japanese Patent Disclosure (Kokai) No2001-76657, paragraph 0016 to 0019, and FIGS. 1 and 2, for example.

The rotating anode X-ray tube is used for a multi-slice type X-ray CT apparatus which reconstructs a plurality of tomographic images along a body axis of the patient. The multi-slice type X-ray CT apparatus includes a multi detector having a plurality of detection element segments in a body axis direction (hereafter referred as a slice direction) of the patient, in order to reconstruct the tomographic images and to collect simultaneously the amounts of X-rays corresponding to the images.

However, in such the multi detector, difference of position of each detection element segment in the slice direction to the rotating anode X-ray tube becomes large. By the positional difference, difference of the apparent focal size, the dose and characteristic of the X-ray (hereafter referred as sensitivity change of X-ray characteristics) occurs, as shown in FIG. 9. Especially, in a new multi-slice type X-ray CT apparatus which has huge numbers of detection element segments, such as 128-or 256, since the difference of the position in the slice direction of each detection element segment become very large the sensitivity change of characteristics of the X-ray shall be considered. In an old multi-slice type X-ray CT apparatus where the number of detection element segments is 4 to 16, since the difference of the position in the slice direction of each detection element segment is not large, the sensitivity change of characteristics of the X-ray is not considered.

In the new multi-slice type X-ray CT apparatus, it is required that more exact projection data is collected in order to reconstruct the tomographic image in high resolution. In order to realize reconstruction in the high resolution, the X-ray which has an exact and uniform dose distribution is irradiated to the patient, and the projection data is collected by each detection element segment.

As described above, the dose distribution of the X-ray irradiated from the rotating anode X-ray tube is almost uniform in the body axis direction of the patient. However, the dose distribution in the slice direction of each detection element segment is a distribution which corresponds to the positional difference, and that is, the dose distribution has a gradual inclination. Therefore, quality of the tomographic image reconstructed based on the projection data detected by each detection element segment is nonuniform because of the difference of the dose distribution of the X-ray resulting from the difference of the position of the detection element segment.

SUMMARY

One object of the present invention is to ameliorate the above-mentioned problems. According to one aspect of the present invention, there is provided an X-ray tube comprising a cathode configured to emit a heat electron, a target, including a plurality of areas where target angles are different in a rotation direction, which the heat electron collides with, and a rotation mechanism configured to rotate the target in the rotation direction.

According to another aspect of the present invention, there is provided an X-ray CT apparatus comprising an X-ray tube including a cathode configured to emit a heat electron, a target, including a plurality of areas where target angles are different in a rotation direction, which the heat electron collides with, and a rotation mechanism configured to rotate the target in the rotation direction, an X-ray detector configured to detect an X-ray irradiated from the X-ray tube, and a reconstruction unit configured to reconstruct an X-ray image based on data detected by the X-ray detector.

BRIEF DESCRIPTION OF THE DRAWINGS

A more complete appreciation of the invention and many of the attendant advantages thereof will be readily obtained as the same becomes better understood by reference to the detailed description when considered in connection with the accompanying drawings.

In the drawings.

DETAILED DESCRIPTION OF EXEMPLARY EMBODIMENTS

An embodiment of an X-ray CT apparatus is explained, referring to drawings.

Figure 1:
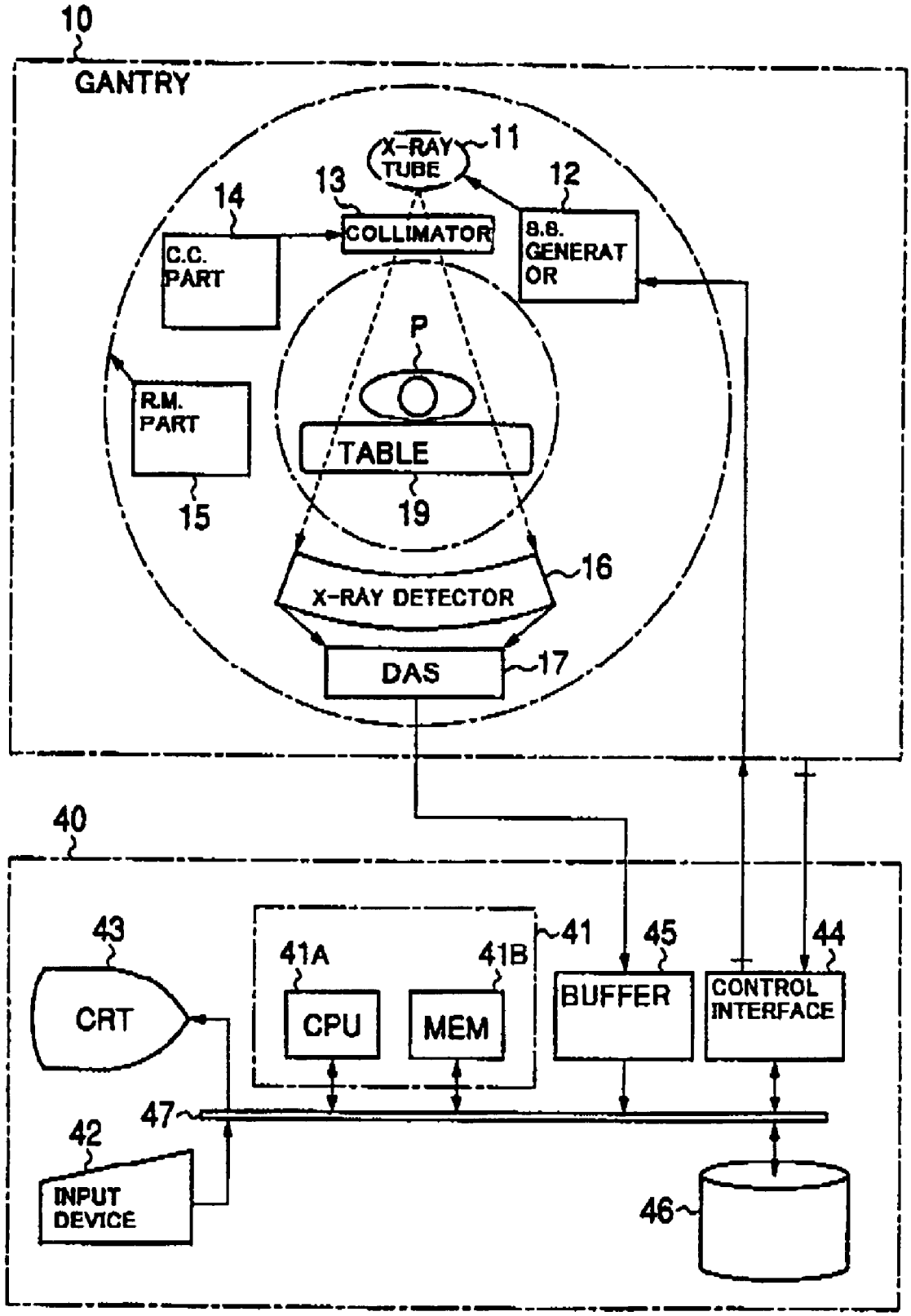
FIG. 1 is a block diagram of an X-ray CT apparatus of the frat embodiment.

A whole composition of the X-ray CT apparatus is explained, referring to FIG. 1. As shown in FIG. 1, the X-ray CT apparatus includes a gantry 10 for performing a helical scan using X-ray spreading in a fan shape in a body axis direction of a patient P, a table 19 which carries the patient P-and moves in the body axis direction and an operation console 40 with which a user operates the gantry 10 and the table 19, for example.

In the gantry 10, there are a rotating anode X-ray tube 11, an X-ray control part 12 which controls the X-ray tube, such as an tube voltage, tube current and a radiation time, a collimator which limits an X-ray radiation range in the body axis direction and in a body width direction, and a collimator control part 14 which controls a position of the collimator 13. Furthermore, in the gantry 10, there are an X-ray detector 16 where a plurality of X-ray detection element segments are arranged in a shape of an array, a data acquisition system (DAS) 17 which acquires projection data detected by the X-ray detector 16, and a rotation mechanism part 15 which rotates the X-ray detector 16 and the DAS 17, etc., around the body axis of the patient P.

Figure 2:
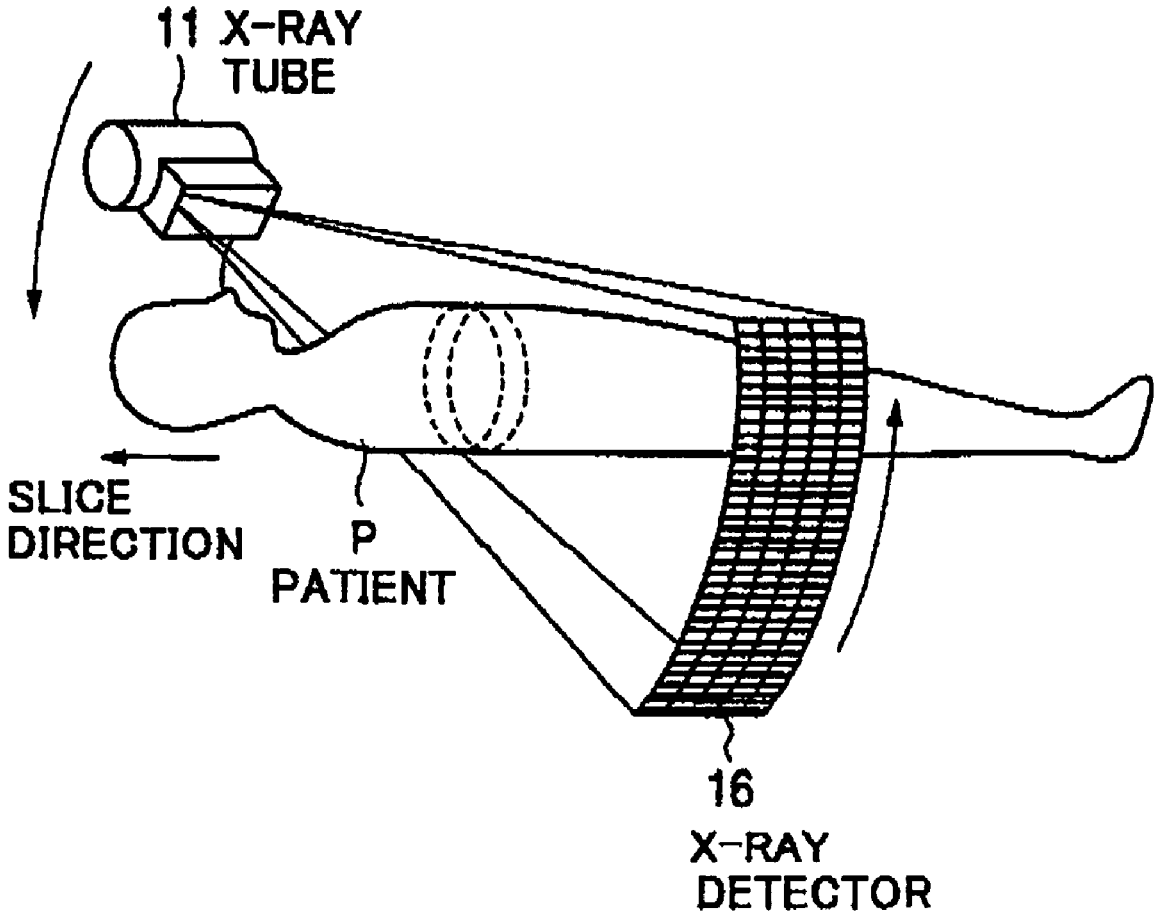
FIG. 2 is an illustration for explaining an X-ray detector.

The plurality of X-ray detection elements are arranged in the body axis direction and the body width direction of the patient P as shown in FIG. 2, and the X-ray detector 16 collects the projection data for every or some detection element segments arranged in the slice direction The operation console 40 includes a central processing unit 41 which performs a main control processing (scanning control, image reconstruction processing, etc.) of the X-ray CT apparatus, an input device 42 which includes a keyboard, a mouse, etc., and a display 43, such as a CRT or LCD, which displays imaging parameters for an imaging plan (tube voltage, tube current, scanning time, slice thickness in the body axis direction, etc.) and a tomographic image, etc. The central processing unit 41 includes a CPU 41A and a main memory 41B which is used with the CPU41A.

The operation console 40 includes a control interface 44 which performs an exchange of various kinds of control signals or a monitor signal between CPU41A and the gantry 10 and the table 19, a buffer 45 which memorizes the projection data from the DAS 17, a secondary memory storage 46, such as a disk, which stores various data or an application program required for operating the X-ray CT apparatus, and a common bus 47 of the CPU41A.

In an operation of an X-ray imaging of the X-ray CT apparatus, the X-ray irradiated from the rotating anode X-ray tube 11 passes through the patient P, and the X-ray enters each detection element of the X-ray detector 16. The DAS 17 acquires the projection data of the patient P from each detection element of the X-ray detector 16, and stores the projection data in the buffer 46. At the time of data acquisition, a scan for acquiring the projection data one by one in each detection element segment arranged in the slice direction is performed.

In a position where the gantry 10 is rotated slightly, the scan is performed again and the projection data is acquired and stored. While the gantry 10 rotates several times, the table 19 is moved in the body axis direction of the patient P intermittently/continuously to acquire and store whole projection data within the imaging range in the helical scanning method. Based on the whole projection data, the CPU41A reconstructs a plurality of CT tomographic images of the patient P, and displays the images on the display 43.

Figure 3:
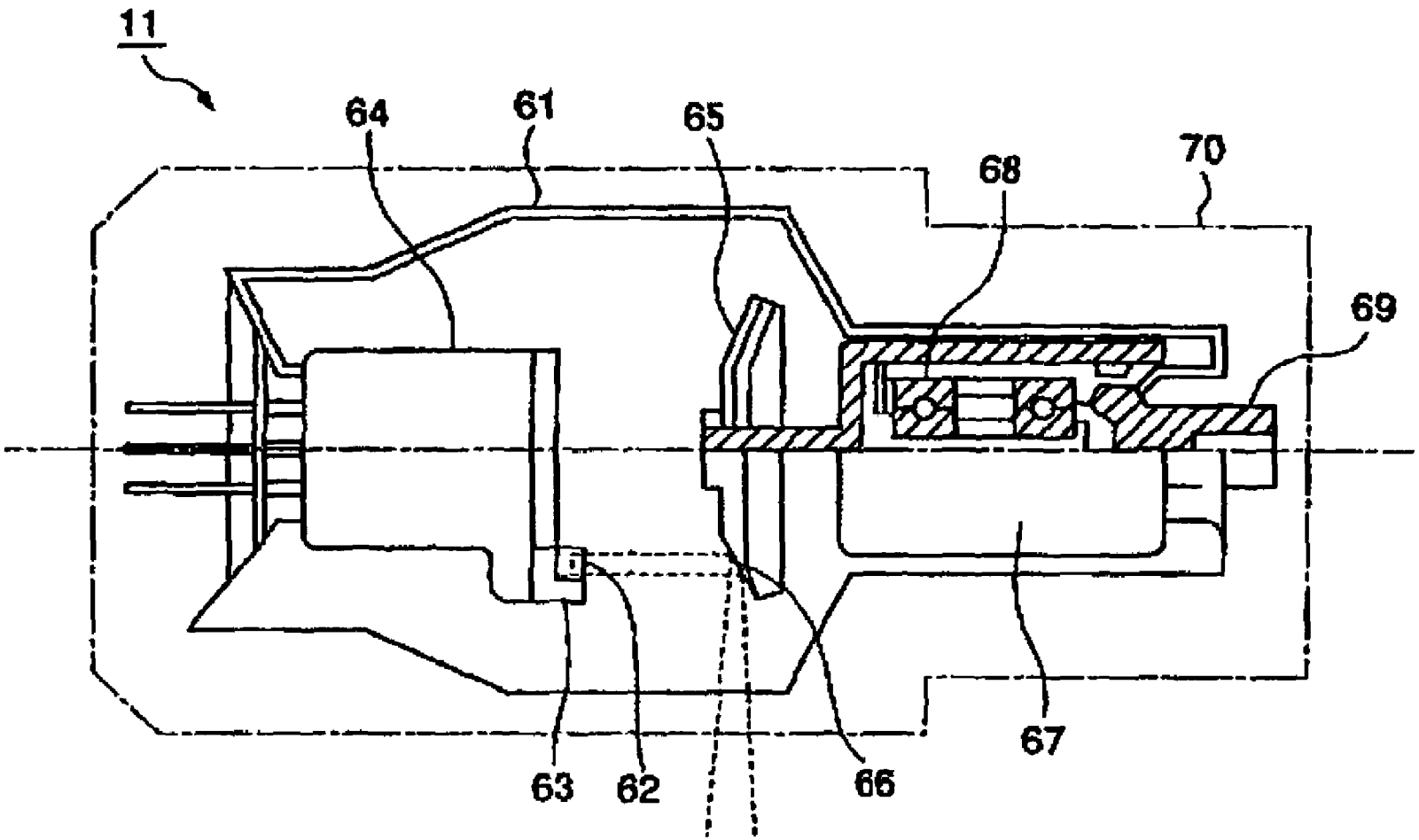
FIG. 3 is a sectional view of a rotating anode X-ray tube.

Next, the rotating anode X-ray tube 11 shown in FIG. 1 is explained, referring to FIG. 3. As shown in FIG. 3, the rotating anode X-ray tube 11 includes a tube container 61 which holds inside of tube with vacuum, a filament 62 which generates a heat electron, a focusing electrode 63 which focuses the accelerated heat electron generated from the filament 62, and a cathode sleeve 64 which supports the filaments 62 and the focusing electrode 63. Furthermore, the rotating anode X-ray tube 11 includes a target 65 which has an umbrella-shaped tungsten disk etc., and which generates the X-ray by the heat electron colliding, a rotation mechanism part 67 which rotates and supports the target 65, a bearing 68 which supports the rotation mechanism part 67, and an anode axis 69 which supports an anode side of the rotating anode X-ray tube 11.

The rotation mechanism part 67 rotates at high speed by a magnetic field (rotation magnetic field etc.) generated from a stator coil positioned around the tube container 61. An inclination angle of the umbrella-shaped portion of the target 65 is formed so that the X-ray emitted from the target 65 enters all or some detection element segments of the X-ray detector 16 simultaneously. At this time, since much heat is generated from the rotating anode X-ray tube 11, the rotating anode X-ray tube 11 is covered with a housing 70, such as a product made from aluminum, and a cooling oil is circulated from outside into the housing 70 to cool the rotating anode X-ray tube 11.

The heat electron generated from the filament 62 is accelerated by the high voltage impressed between the cathode sleeve 64 and the rotation mechanism part 67, and is focused by the focusing electrode 63 on a focus 66 of the target 65 as an electron beam. Thereby, the X-ray is generated in the focus 66 of the target 65. Since the conversion efficiency to the X-ray of the heat electron is as low as 1% or less, most of energy is changed into heat which occurs especially in the focus 66. For this reason, the target 65 is rotated around the anode axis 69 at high speed (about 100–to 160 Hz) to expand an effective area of the focus 66 and to avoid overheating which could cause of damage or breakage of the X-ray tube 11, during obtaining an appropriate output of the X-ray.

Figure 4A:
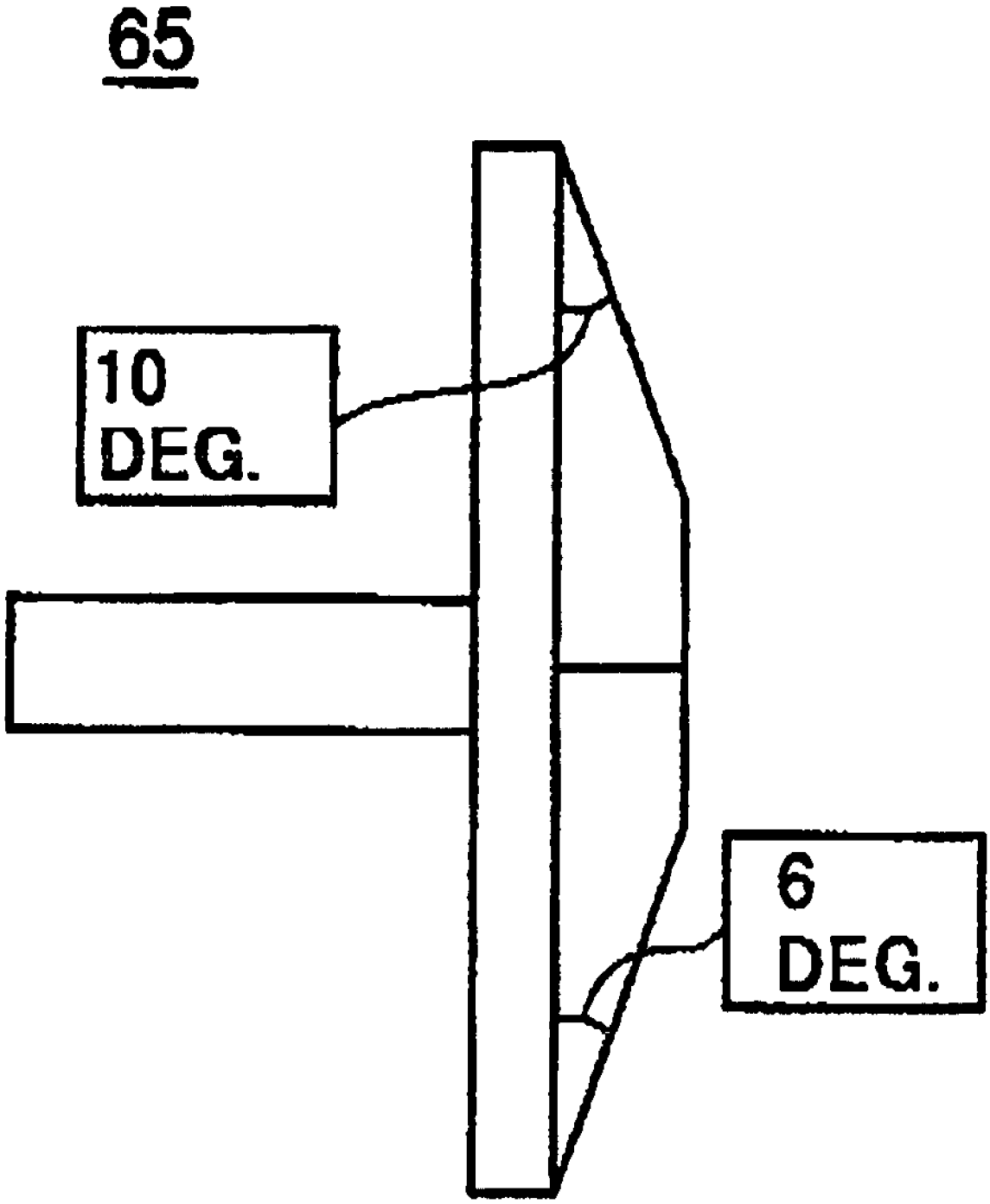
FIG. 4A is a side view of a target.
Figure 4B:
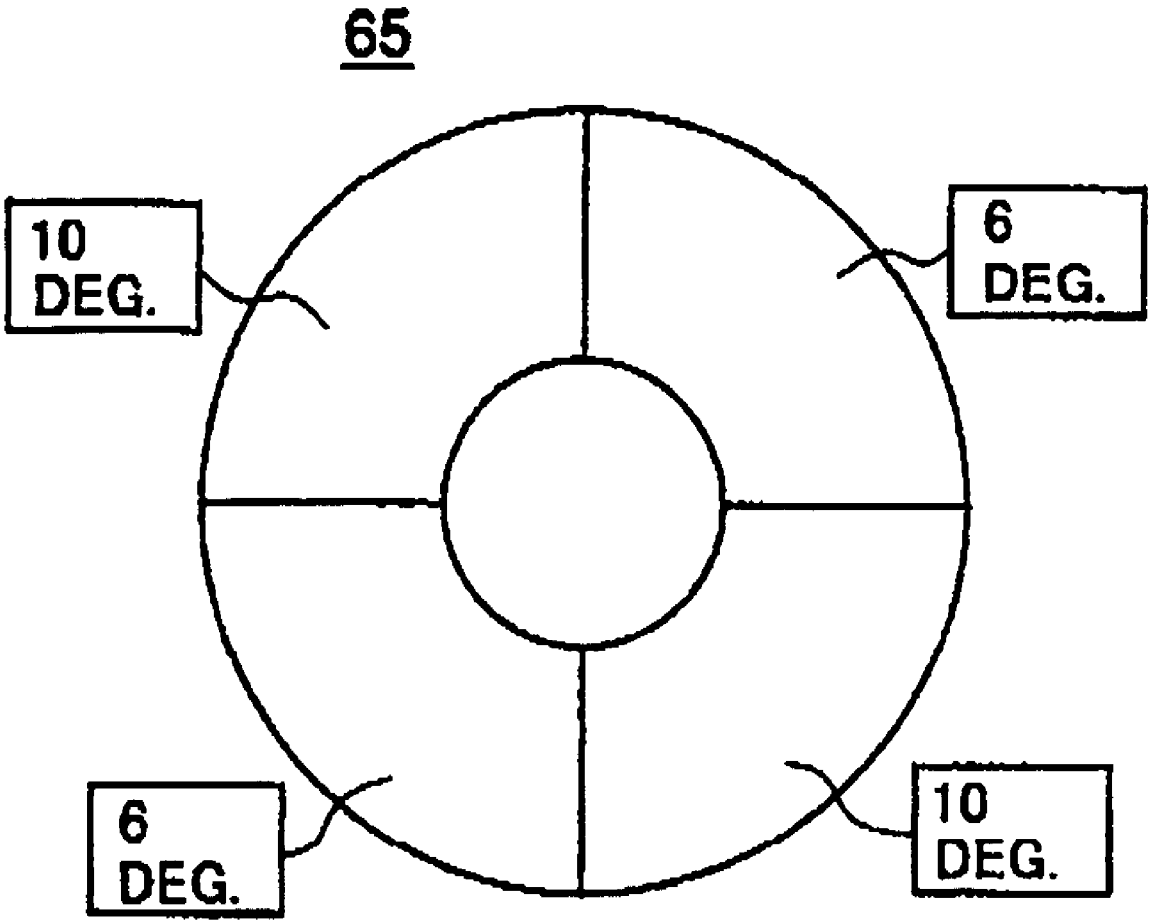
FIG. 4B is a front view of the target.

The target 65 of the rotating anode X-ray tube 11 is explained, referring to FIG. 4A and FIG. 4B. As shown in FIG. 4A and FIG. 4B, the target 65 has a plurality of divided areas in the rotation direction, and the divided areas have different target angles. For example, the areas are positioned for every 90 degrees of the rotation angles and the target angles in the areas are 6 degrees and 10 degrees in turn. When the target 65 is rotated 90 degrees by the rotation magnetic field from the stator coil, the target angle is changed at 6 degrees and 10 degrees. The X-ray generated from the target 65 is irradiated according to the target angle, and the dose distribution is uniform to each detection element segment in the slice direction of the X-ray detector 16. Borderline where the divided areas are mutually adjacent is formed smoothly to avoid that the energy of the heat electron loses extremely with the borderline.

When stability at the time of rotation of the target 65 is considered, the number of the divided areas and the target angles may be symmetrical about a rotation center positioned on the rotation axis. For example, it is desirable that the number of the divided areas are four or eight, and the target angles are classified into two groups, each of which is alternatively repeated in the same number of times in the rotation direction. However, it may not be symmetrical about a point.

The target angles are determined according to a distance between the X-ray detectors 16 and the target 64 and an incidence angle of the heat electron from the filament 62 to the target 65. Since a target of a conventional multi-slice type X-ray CT apparatus is generally from 7 degrees to 9 degrees, it is desirable that the target angle is set 6 degrees or 10 degrees, or near.

Figure 5A:
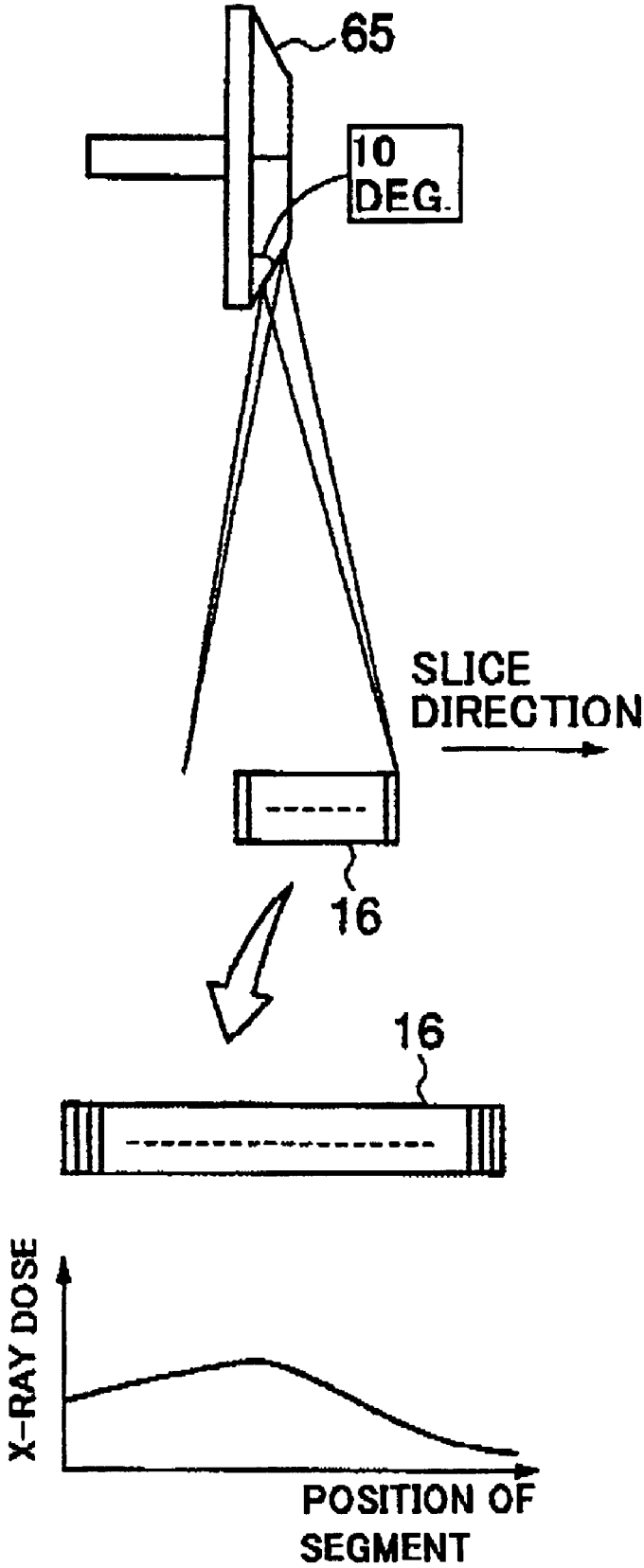
FIGS. 5A and 5B are illustrations for explaining that difference of dose distribution of X-ray irradiated to each detection element segment is reduced.
Figure 5B:
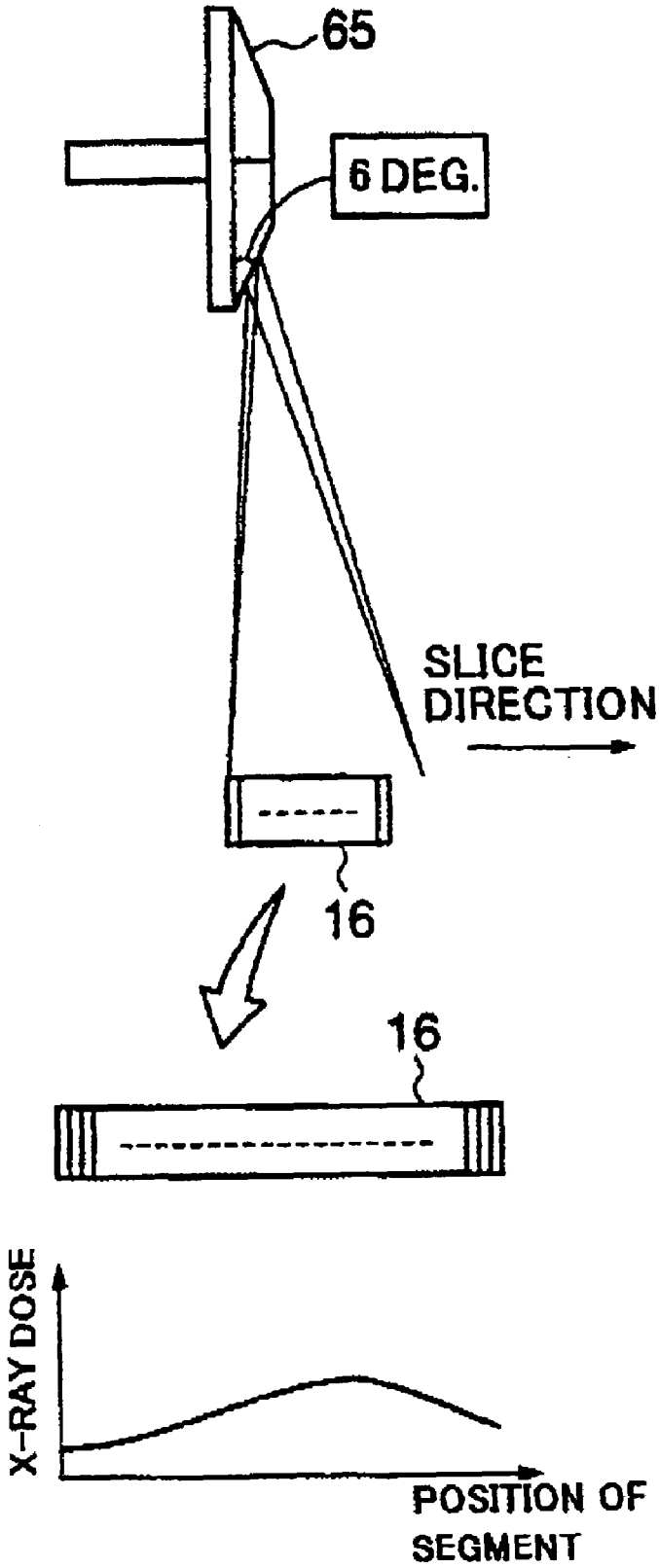
Figure 6:
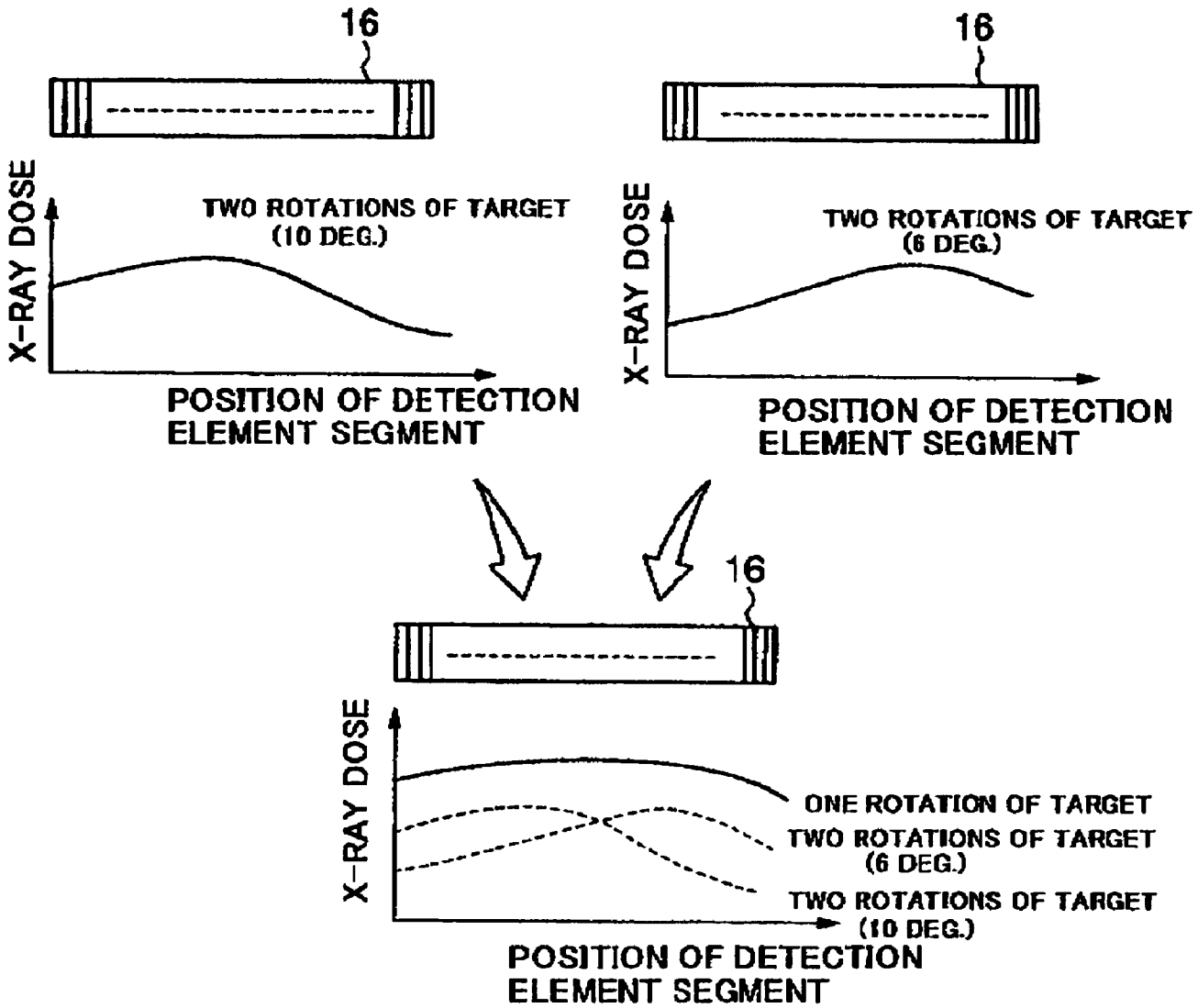
FIG. 6 is an illustration for explaining that difference of dose distribution of X-ray irradiated to each detection element segment is reduced.
Figure 9:
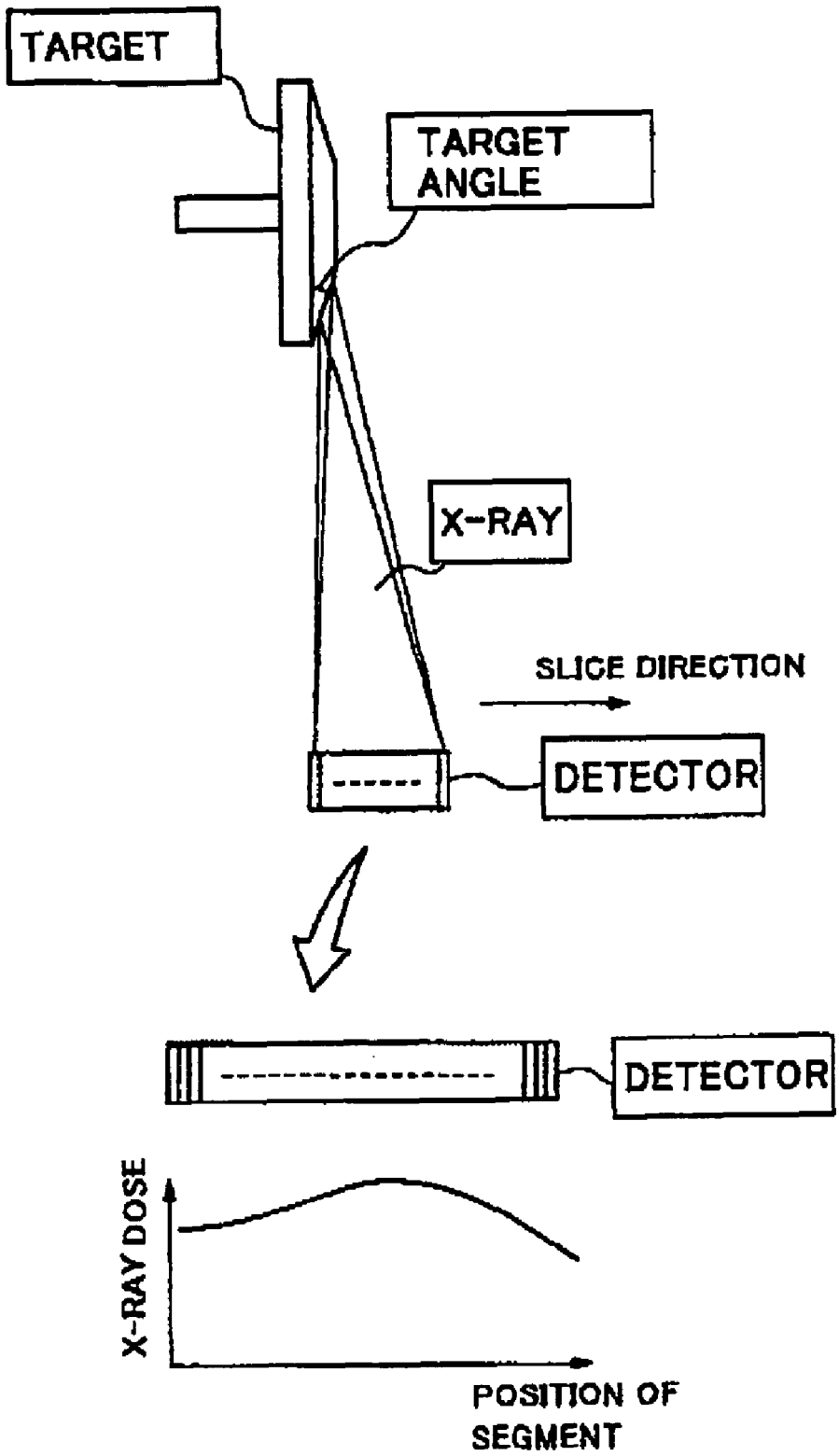
FIG. 9(PRIOR ART)
FIG. 9 is an illustration for explaining the difference of the dose distribution in a conventional X-ray CT apparatus.

As shown in FIG. 5A and FIG. 5B, the X-ray emitted from the target 65 is irradiated in directions corresponding to the target angles of 6 and 10 degrees to each detection element segment in the slice direction of the X-ray detector 16. A total dose distribution is, as shown in FIG. 6, more uniform than the conventional dose distribution shown in FIG. 9. The X-ray emitted from the target 65 is irradiated in directions corresponding to the target angle of 6 and 10 degrees repeatedly, and the total dose distribution shows that the dose distributions for irradiations of 6 and 10 degrees are added in FIG. 6A and FIG. 6B.

The rotation cycle of the target 65 is adjusted to 1 for N (N=an integer) of data collection cycle which is a cycle until the data collection in each detection element segment is completed one time. The radiation of the X-ray emitted from the target 65 is repeated N times, and total dose amount is N multiplied by values shown in FIG. 6A and FIG. 6B. The total dose amount corresponds to the conventional dose amount shown in FIG. 9.

Therefore, by changing the irradiation direction of the X-ray emitted from the target 65 in this way two or more times, since the difference of the dose distribution is reduced in each detection element segment in the slice direction of the X-ray detector 16, the difference of the quality of image of the tomographic images reconstructed based on the projection data detected by each detection element segment can be reduced.

In order to avoid the nonuniformity in the dose distribution of the X-ray irradiated to each detection element segment in the data collection cycle, it may be adopted to control the X-ray tube 11 such that the rotation cycle is 1 for N of the data collection cycle.

That is, the rotation cycle of the target 65 is adjusted to 1 for N of the data collection cycle such that the radiation direction of the X-ray to each detection element segment is changed N times in the data collection cycle.

Figure 7:
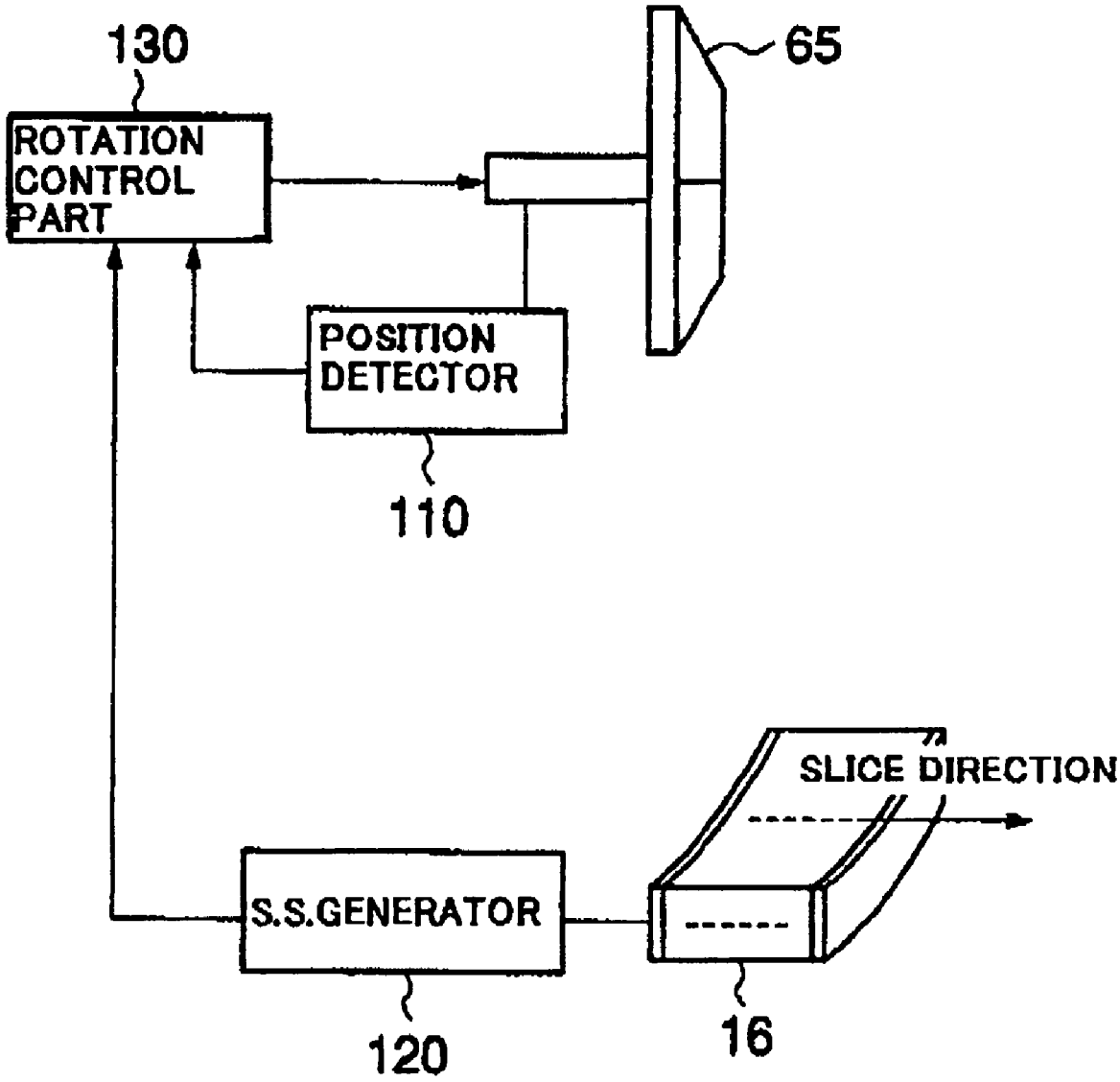
FIG. 7 is an illustration for explaining a control of rotation cycle of a target.

A block diagram for explaining to control the rotation cycle of the target 65 to 1 for N of the data collection cycle of the X-ray detector 16 is shown in FIG. 7. As shown in FIG. 7, a position detector 110, such as a rotary encoder which detects a rotation position, is provided near the rotation axis of the target 65. Moreover, a synchronized signal generator 120 which generates a synchronized signal for indicating when the data collection in each detection element segment is started and completed is provided. The synchronized signal is used for the data collection cycle and N multiplied by the rotation cycle.

A rotation control part 130 which may be combined with the X-ray control part 12 calculates the data collection cycle based on the position signal about the rotation position of the target 65 outputted from the position detector 110 and the synchronized signal generated from the synchronized signal generator 120. In detail, the time difference between the stating time and the completed time is calculated. The rotation control part 130 controls intensity of the rotation magnetic field generated by the stator coil based on the calculated data collection cycle, in order to adjust rotation speed of the target 65 such that the rotation cycle of the target 65 corresponds to 1 for N of the data collection cycle.

Therefore, as mentioned above, the nonuniformity of the dose distribution is reduced.

Furthermore, in order to reduce the nonuniformity of the X-ray by the heat electron collides with the borderline of the divided areas, the rotation control part 130 may control an emission of the heat electron generated from the filament 62 such that the collision of the heat electron to the borderline is avoided.

Figure 8:
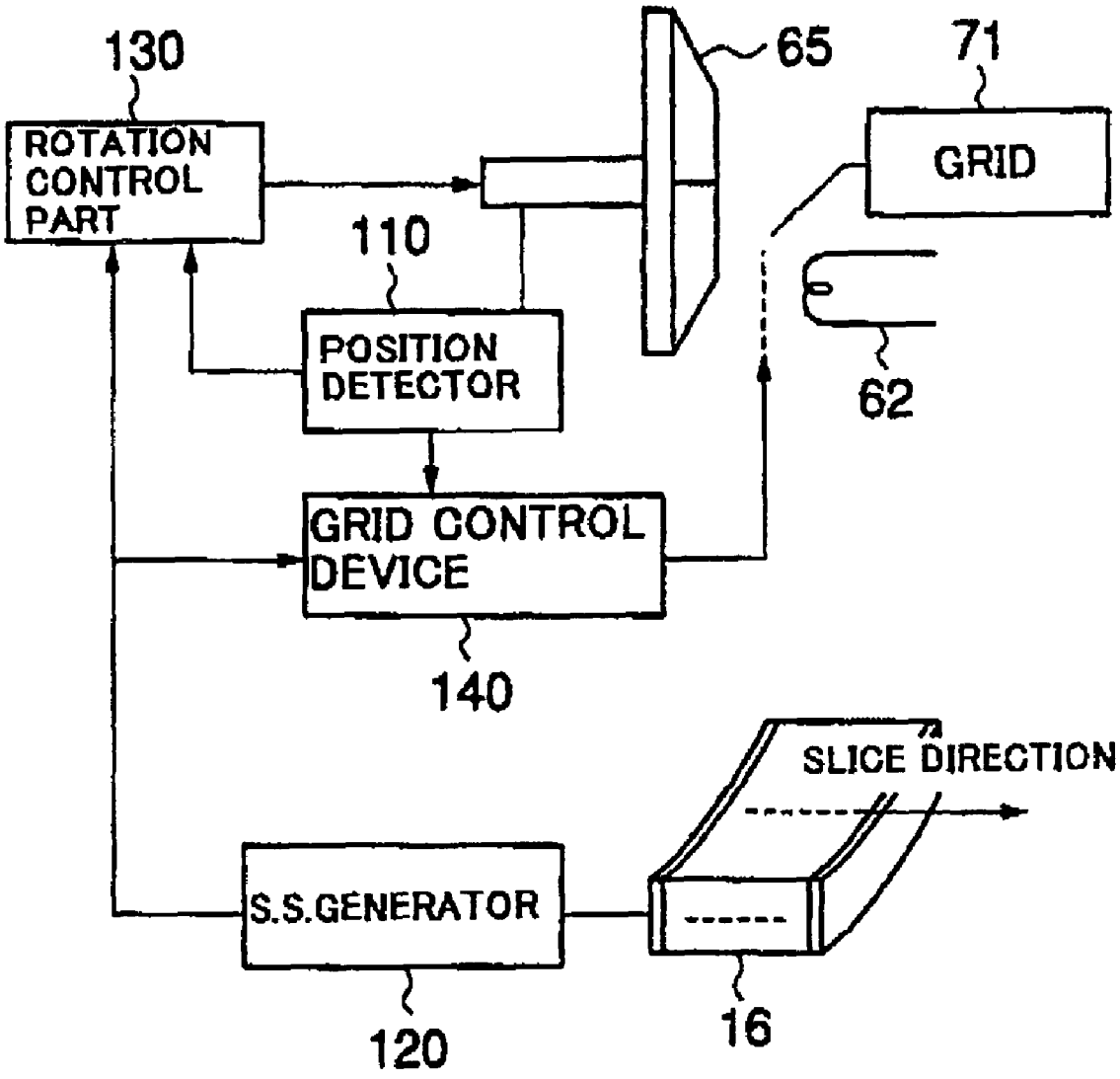
FIG. 8 is an illustration for explaining a control of output of a heat electron generated from a filament.

A block diagram for explaining a control of the emission of the heat electron generated from the filament 62 is shown in FIG. 8. As shown in FIG. 8, the position detector 110 and the synchronized signal generator 120 are provided as well as FIG. 7. Furthermore, a grid 71 which generates a magnetic field in such a direction that the emission of the heat electron is blocked is positioned in a front of the filament 62. A grid control device 140 impresses a negative bias voltage on the grid in a predetermined timing to control the timing of the emission of the heat electron. The borderlines of the divided areas of the target 65 are recognized based on the position signal from the position detector 110. A relationship between the rotation position of the target 64 and positions of the borderlines is determined in advance. The grid control device 140 impresses the negative bias voltage on the grid 71 such that the heat electron collides with the target 65 except the borderlines. Further, the grid control device 140 adjusts the impression of the negative voltage in the predetermined timing based on the synchronized signal generated from the synchronized signal generator 120, in order to irradiate X-ray from the target 65 within the data collection cycle of the X-ray detector 16. To simplify the explanation, the other explanations of the construction of FIG. 8 are omitted by attaching the same reference numbers in FIG. 7. As mentioned above, the difference of dose distribution in the slice direction is reduced, and the tomographic images, each of which quality is uniform, are obtained.

The present invention may be not limited to the above embodiment, and various modifications may be made without departing from the spirit or scope of the general inventive concept.

In the X-ray CT apparatus in the above embodiment, the alternative change of the target angles of 6 degrees and 10 degrees for four divided areas is explained, however other number of divided areas or other target angles may be adopted. For example, when the stability of the rotation is permitted, other divided areas or target angles which are not symmetrical about a point may be adopted. Or a center of gravity of the target 65 may be positioned on the rotation axis of the target 65, in order to improve the stability. Moreover, a target angle is determined according to the incidence angle of the heat electron from the filament 62 which collides with a target 65, and the distance between the X-ray detectors 16 and a target 64, and other angles may be adopted. Moreover, although a case where the grid is used for controlling irradiation of X-ray is explained in the above embodiment, a collimator which is positioned outside of X-ray tube may be used.

Moreover, although two or more detection element segments which are arranged is explained, a flat panel detector where detection elements are arranged in a matrix may be adopted.

In the above embodiment, four divided areas are mainly explained, however other numbers of the divided areas may be adopted. In addition, the divided areas may be adjacent much smoothly so that the borderlines are not recognized.

What is claimed is:

1. An X-ray CT apparatus, comprising:

an X-ray tube including (1) a cathode configured to emit a heat electron, (2) a target, including a plurality of areas where target angles are different in a rotational direction, which the heat electron collides with, and (3) a rotation mechanism configured to rotate the target in the rotational direction;

an X-ray detector configured to detect an X-ray irradiated from the X-ray tube;

a reconstruction unit configured to reconstruct an X-ray image based on data detected by the X-ray detector, said reconstruction unit configured to perform image reconstruction based on a total dose distribution received by said X-ray detector from irradiation by at least two of the target areas having different target angles;

a position detector configured to detect a rotation position of the target; and an emission controller configured to control an emission of the heat electron such that the heat electron collides with the target except at a borderline positioned between the areas, wherein the emission controller comprises:

a grid configured to generate a magnetic field in such a direction that the emission of the heat electron is blocked; and a grid controller configured to impress a negative bias voltage on the grid in a predetermined timing to control a timing of the emission of the heat electron.

2. The X-ray CT apparatus according to claim 1, wherein the X-ray detector includes a plurality of detection element segments which are arranged in a body axis of an object.

3. The X-ray CT apparatus according to claim 1, further comprising a rotation controller configured to control a rotation speed of the target such that a data collection cycle corresponds to N (N=integer) multiplied by a rotation cycle of the target.

4. The X-ray CT apparatus according to claim 3, further comprising a signal generator configured to generate a signal for indicating when data collection in each detection element segment is started and completed.

5. An X-ray CT apparatus, comprising:

an X-ray tube including a cathode configured to emit a heat electron, a target, including a plurality of areas where target angles are different in a rotation direction, which the heat electron collides with, and a rotation mechanism configured to rotate the target in the rotation direction;

an X-ray detector configured to detect an X-ray irradiated from the X-ray tube;

a reconstruction unit configured to reconstruct an X-ray image based on data detected by the X-ray detector;

a position detector configured to detect a rotation position of the target; and an emission controller configured to control an emission of the heat electron such that the heat electron collides with the target except at a borderline positioned between the areas, wherein the emission controller comprises:

a grid configured to generate a magnetic field in such a direction that the emission of the heat electron is blocked; and a grid controller configured to impress a negative bias voltage on the grid in a predetermined timing to control a timing of the emission of the heat electron.

* * * * *